US006253946B1

(12) United States Patent
Mäkinen

(10) Patent No.: US 6,253,946 B1
(45) Date of Patent: Jul. 3, 2001

(54) CLOSURE FOR A CAN OF DRINK WHICH CAN BE OPENED WITH ONE HAND

(75) Inventor: Mauri Mäkinen, Espoo (FI)

(73) Assignee: Oy Modux AB, et al., Espoo (FI)

( * ) Notice: Subject to any disclaimer, the term of this patent is extended or adjusted under 35 U.S.C. 154(b) by 0 days.

(21) Appl. No.: 09/530,249

(22) PCT Filed: Oct. 29, 1998

(86) PCT No.: PCT/FI98/00841

§ 371 Date: Apr. 26, 2000

§ 102(e) Date: Apr. 26, 2000

(87) PCT Pub. No.: WO99/22997

PCT Pub. Date: May 14, 1999

(30) Foreign Application Priority Data

Oct. 30, 1997 (FI) ..... 974099

(51) Int. Cl.[7] ..... B65D 17/28

(52) U.S. Cl. ..... 220/268; 220/269; 220/270; 220/712

(58) Field of Search ..... 220/268, 269, 220/270, 906, 712

(56) References Cited

U.S. PATENT DOCUMENTS

| | | | | |
|---|---|---|---|---|
| 3,355,058 | | 11/1967 | Asbury . | |
| 3,779,417 | | 12/1973 | Klein . | |
| 3,927,794 | * | 12/1975 | Erdman | 220/268 |
| 4,018,357 | * | 4/1977 | Ostrem | 220/268 |
| 4,078,693 | * | 3/1978 | Asbury | 220/268 |
| 4,078,694 | * | 3/1978 | Gnyp et al. | 220/268 |
| 4,359,170 | * | 11/1982 | Edlund | 220/268 |
| 4,465,203 | * | 8/1984 | Lambert | 220/268 |
| 4,553,684 | * | 11/1985 | Bennett | 220/268 |
| 4,585,140 | | 4/1986 | Lambert . | |
| 4,784,283 | * | 11/1988 | Cantu | 220/269 |
| 4,909,407 | * | 3/1990 | Lambert et al. | 220/268 |
| 5,147,057 | * | 9/1992 | Marshall et al. | 220/268 |
| 5,535,911 | | 7/1996 | Cortez . | |
| 5,894,950 | * | 4/1999 | Kick | 220/268 |

FOREIGN PATENT DOCUMENTS

| | | |
|---|---|---|
| 28 47 323 A1 | 5/1980 | (DE) . |
| 1 415 935 | 12/1975 | (GB) . |
| 2 294 446 | 5/1996 | (GB) . |

* cited by examiner

*Primary Examiner*—Nathan J. Newhouse
(74) *Attorney, Agent, or Firm*—Greenberg Traurig LLP; Joseph M. Manak

(57) ABSTRACT

The invention relates to a closure for a can of drink which is made in one piece and can be opened with one hand. Owing to the design of the closure, no supplementary parts are needed in the closure to open the closure.

3 Claims, 2 Drawing Sheets

CLOSURE FOR A CAN OF DRINK WHICH CAN BE OPENED WITH ONE HAND

A prerequisite for a can closure is to withstand the pressure generated by the carbonated drink contained in the can while still being easy to open.

There are various types of prior art closures for a can drink, which, to open the can, have the common feature of comprising a ring, strip or similar, appropriately fastened by rivets to the closure. Such additional components often end up in the nature and increase the strain on the environment. Also, it is awkward to open such cans with one hand, for instance a driver trying to do so may jeopardise traffic safety. Patent specifications DE 28 47 323, GB 1,415,935, GB 2,294,446 and U.S. Pat. No. 5,535,911 describe various solutions aiming to open closures for of drink cans with one hand, however, these solutions have not been satisfactory in practical operation. These references and the solutions described in them explicitly represent the state of the art. Their solutions do not have the benefits this invention does.

The invention relates to a closure for a can of drink formed in one piece which can be opened with one hand, in which a projection from where guide scores start has been formed. The closure in accordance with the invention is characterised by the fact that the projection has essentially abrupt walls and is equipped with a peak from where the guide scores start, in alignment with the join between the abrupt projection walls and the closure, and that the guide score continues from the guide score join away from the projection, and that the closure tears along these guide scores when the projection is pressed down against the closure.

Various embodiments of the invention are set forth in the dependent claims of the set of claims.

A closure for a can of drink which is made in one piece has the obvious productional advantages of not requiring additional components such as strips, rings and rivets, and of requiring clearly fewer operation steps in the manufacture of the closure. The advantages thus achieved involve faster and less expensive production, no need of machines, storage space or handling equipment for supplementary parts, and less strain on the environment.

Figure 1:
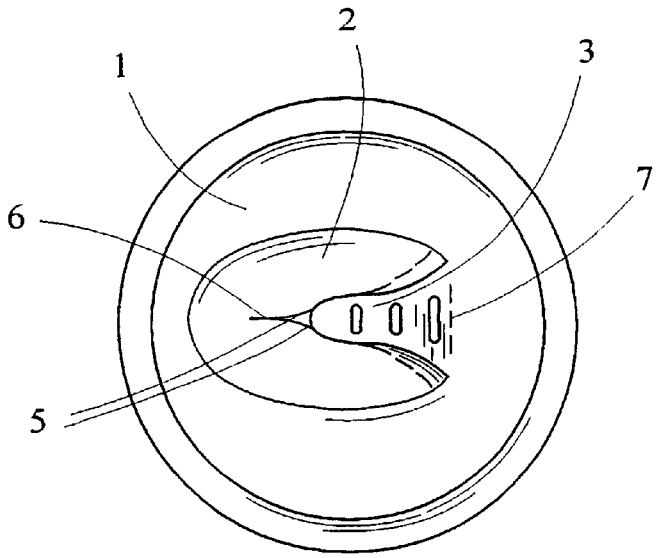
Figure 2:
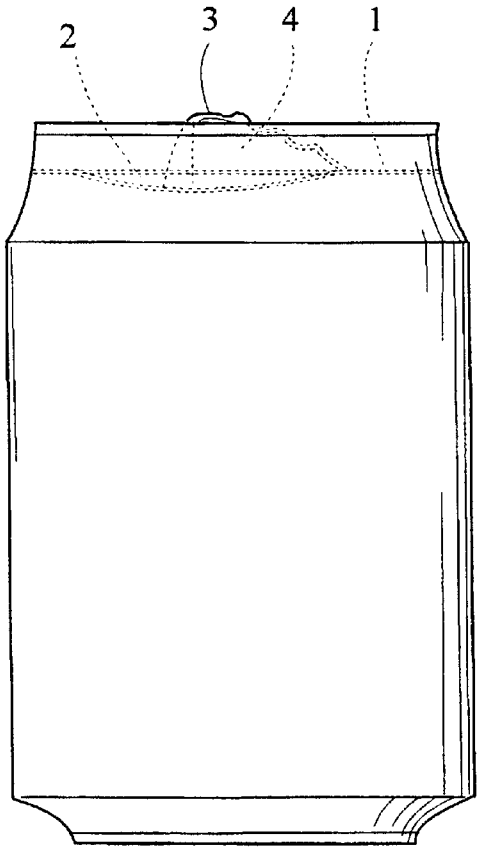
Figure 3:
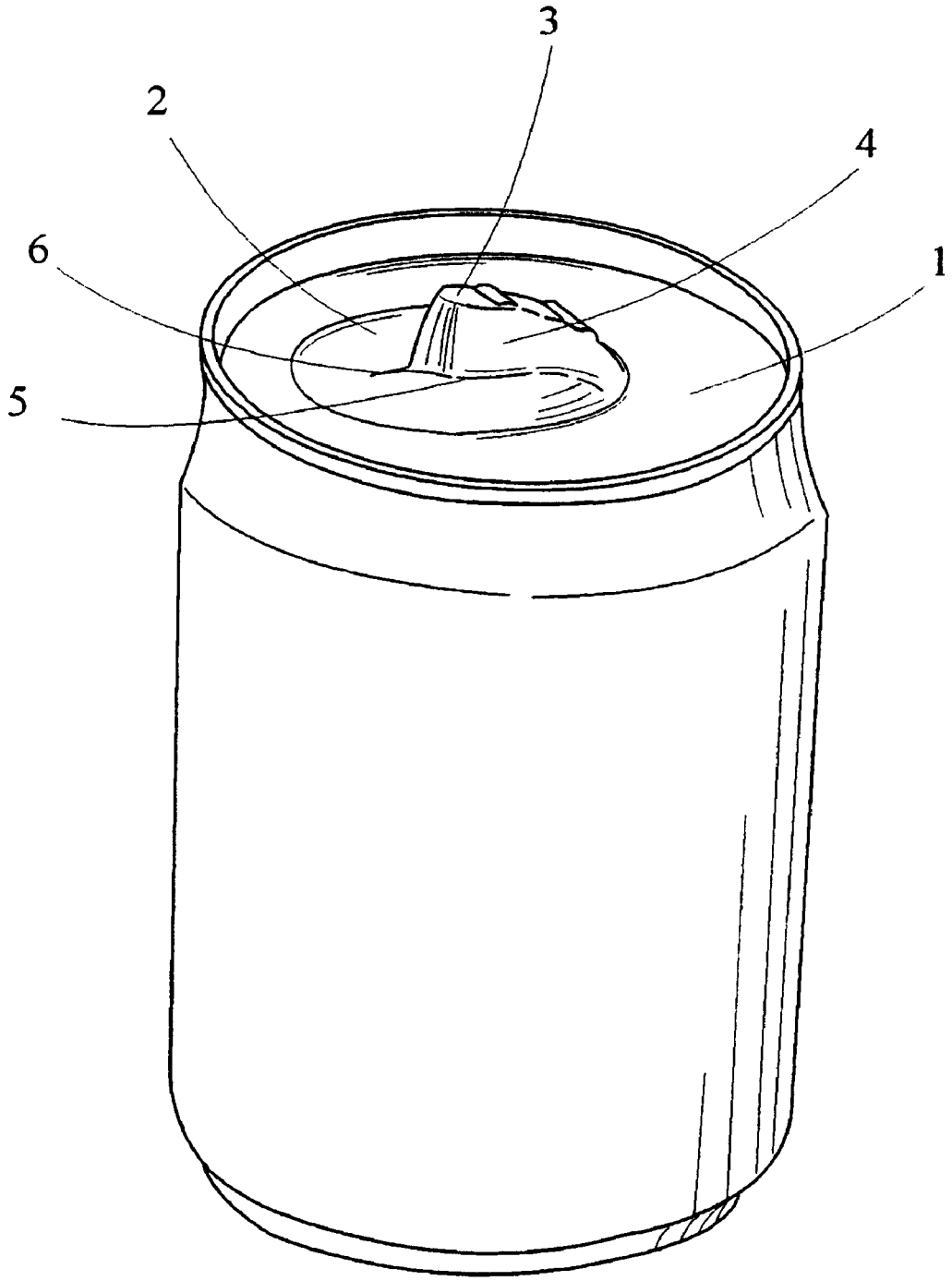

The invention is described below with the aid of an example and with reference to the accompanying drawings, of which FIG. 1 is a top view of the closure in accordance with the invention, FIG. 2 is a lateral cross-section of the closure in accordance with the invention, and FIG. 3 is a perspective view of the closure in accordance with the invention.

In the preferred embodiment of the can of drink in accordance with the invention, a projection 3 shaped essentially as an acute-angled triangle projecting from the plane of closure 1 has been pressed into closure 1, projection 3 rising from its shortest side towards its most acute angle so that its walls are most abrupt around the acute angle. Around projection 3 closure 1 has an area 2 which is smoothly concave viewed from above. The concave area has the purpose of stiffening the horizontal portion of the closure so that, when the projection is being pressed, its peak applies a maximum of force to the closure.

In the area where projection 3 rises sharply, closure 1 is provided with reducing scores 5 in alignment with the longitudinal sides of projection 3, closure 1 being torn along the scores when the narrow end of projection 3 is pressed for instance with the user's thumb. Reducing scores 5 run along the longitudinal sides of projection 3 in the vicinity of the peak and the top portion of projection 3 and diverge from the vicinity of the lateral walls 4 of the projection as they approach the bottom end of the projection, and end essentially at the edge of the concave area.

In the preferred embodiment, from the point where reducing scores 5 essentially join at the point of the acute-angled triangle in closure 1, a guide score 6 starts and continues parallel with the height of the acute-angled triangle away from the triangular projection 3 in the concave area 2.

In the preferred embodiment, a fitting 7 is provided at the point where projection 3 starts rising from the plane of closure 1, the fitting extending parallel with the base of the acute-angled triangle but covering only part of the base. The purpose of this fitting is to provide an opening/openings in the closure when the projection is being pressed to open the closure. The portion of the triangle base located outside fitting 7 acts as a hinge about which projection 3 swings when being pressed.

Although closure 1 is of the same material throughout and has been pressed in one piece, its design enables projection 3 to be pressed with the maximum force applied to the join between the peak and the concave area of projection 3, from where guide scores 5 and 6 start. The closure will then tear along guide scores 5 and 6, providing an opening through which the drink can be poured. When projection 3 is further pressed down through the closure, strain will be generated in the projection base, causing fitting 7 to tear and resulting in a compensating vent in the closure, which makes it easier to pour the drink from the can.

On top of projection 3 a design is provided to prevent the projection from slipping from the user's thumb grip and making his grip firmer, consisting of e.g. a rough structure or grooving.

Owing to the design and height of projection 3 the can may be opened with relatively small force, and for the same reason, the user who opens the can will not get his thumb hurt or wet.

In addition, the concave area 2 formed around projection 3 in the closure forms a dome-like structure, through which the drink flows from the can when drunk directly from the can.

This dome-like design is soft to the user's lips, whereas currently used cans have drinking openings with sharp edges. With such a sharp edge, a person who opens the can risks to cut his finger or a person drinking from the can risks to wound his lip.

Consequently, the invention has appreciable advantages over previously known solutions.

What is claimed is:

1. A closure (1) for a one-piece drink can, which closure can be opened with one hand, said closure comprising a projection (3) in the shape of an acute-angled triangle having substantially abrupt walls (4), which projection (3) rises from its shortest side towards its most acute angle such that the walls (4) are most abrupt around said most acute angle, said projection (3) provided with a peak from which first and second reducing scores (5) start, said scores (5) being aligned with a joint between the abrupt walls (4) of the projection (3) and the closure (1), wherein guide score (6) continues away from a joinder between the first and second reducing scores 5, and the closure (1) tears along scores (5, 6) when the projection (3) is pressed down against the closure (1), said closure having a smoothly concave area (2) around the projection (3) as viewed from above, and wherein said first and said second reducing scores (5) run in alignment with longitudinal sides of the projection (3) in the vicinity of the peak of the projection (3) and thereafter diverge from the side walls (4) of the projection (3) as scores 5 approach a bottom end of the projection, said scores 5 ending substantially at an edge of the concave area (2).

2. The closure of claim 1, which further comprises a fitting (7) located where the projection (3) begins to rise from the plane of the closure (1), which fitting extends in alignment with the base of the acute-angled triangle, and at which base openings are formed in the closure (1) when the projection (3) is pressed to open the closure (1), said openings forming a vent for introducing compensating air into the can.

3. The closure of claim 2, which further comprises, between the fitting (7) in the base of the projection (3) and free ends of the reducing scores (5) in the closure, a hinged construction formed at the joint between the closure (1) and the concave area (2), wherein the projection rotates about said hinged construction to facilitate pouring of a drink from said can.

* * * * *